US009814923B2

(12) United States Patent
Boekema

(10) Patent No.: US 9,814,923 B2
(45) Date of Patent: Nov. 14, 2017

(54) WEARABLE DEVICE FOR GUIDING A LINE OF A FITNESS APPARATUS

(71) Applicant: INTELECT B.V., Apeldoorn (NL)

(72) Inventor: Robbert Jacobus Johannes Boekema, Apeldoorn (NL)

(73) Assignee: INTELECT B.V., Apeldoorn (NL)

( * ) Notice: Subject to any disclaimer, the term of this patent is extended or adjusted under 35 U.S.C. 154(b) by 186 days.

(21) Appl. No.: 14/772,833

(22) PCT Filed: Mar. 4, 2014

(86) PCT No.: PCT/NL2014/050130
§ 371 (c)(1),
(2) Date: Sep. 4, 2015

(87) PCT Pub. No.: WO2014/137210
PCT Pub. Date: Sep. 12, 2014

(65) Prior Publication Data

US 2016/0030798 A1 Feb. 4, 2016

(30) Foreign Application Priority Data

Mar. 5, 2013 (NL) ..... 2010395

(51) Int. Cl.
*A63B 71/00* (2006.01)
*A63B 23/08* (2006.01)
(Continued)

(52) U.S. Cl.
CPC .... *A63B 21/4013* (2015.10); *A63B 21/00192* (2013.01); *A63B 21/023* (2013.01);
(Continued)

(58) Field of Classification Search
CPC ..... A63B 2209/08; A63B 21/00192; A63B 21/02; A63B 21/023; A63B 21/04;
(Continued)

(56) References Cited

U.S. PATENT DOCUMENTS 3,162,441 A 12/1964 Karlik
5,176,377 A * 1/1993 Wilkinson ..... A63B 21/00069 482/114
(Continued)

FOREIGN PATENT DOCUMENTS

CA 2311044 A1 12/2001
CN 1678373 A 10/2005
(Continued)

OTHER PUBLICATIONS

PCT International Search Report and the Written Opinion, PCT/NL2014/050130, dated May 7, 2014, 8 pages.
(Continued)

*Primary Examiner* — Joshua Lee
(74) *Attorney, Agent, or Firm* — Edell, Shapiro & Finnan, LLC

(57) ABSTRACT

Ankle band 1 for guiding a line of a fitness apparatus. The ankle band comprises a fastener 2, a base element 3 and a guidance element for guiding the line of the fitness apparatus. The guidance element 4 is connected by a linkage member 5 to obtain a movable connection from an initial position to a working position in case that a force is exerted via the line. A resilient member 51 is provided to generate a spring force when the linkage member 5 is moved away from its initial position. The resilient member 51 returns the guidance element 4 back from the working position to the initial position in case that an exerted force reduces. The predetermined initial position is advantageous when attaching the line of the fitness apparatus to the device. The line can be connected to the device by using just a single hand.

15 Claims, 12 Drawing Sheets

(51) Int. Cl.

| | |
|---|---|
| ***A63B 23/10*** | (2006.01) |
| ***A63B 21/02*** | (2006.01) |
| ***A63B 21/00*** | (2006.01) |
| ***A63B 21/055*** | (2006.01) |

(52) U.S. Cl.
CPC ..... *A63B 21/0552* (2013.01); *A63B 21/4015* (2015.10); *A63B 21/4025* (2015.10); *A63B 21/4043* (2015.10)

(58) Field of Classification Search
CPC ..... A63B 21/0407; A63B 21/0428; A63B 21/0552; A63B 21/40; A63B 21/4001; A63B 21/4003; A63B 21/4005; A63B 21/4007; A63B 21/4009; A63B 21/4011; A63B 21/4013; A63B 21/4015; A63B 21/4017; A63B 21/4019; A63B 21/4021; A63B 21/4025; A63B 21/4043; A63B 2022/0079
See application file for complete search history.

(56) References Cited

U.S. PATENT DOCUMENTS

| | | | | |
|---|---|---|---|---|
| 6,120,423 | A | 9/2000 | Mackey et al. | |
| 6,280,365 | B1 * | 8/2001 | Weber | A63B 21/018 482/124 |
| 7,297,090 | B2 * | 11/2007 | Torres | A63B 21/015 482/124 |
| 7,563,212 | B2 * | 7/2009 | Smith | A63B 21/025 482/124 |
| 2004/0043878 | A1 * | 3/2004 | Erwin | A63B 21/0004 482/124 |
| 2012/0232449 | A1 * | 9/2012 | Arnstein | A61H 1/0266 602/16 |
| 2013/0017935 | A1 | 1/2013 | Endelman et al. | |

FOREIGN PATENT DOCUMENTS

| | | | |
|---|---|---|---|
| CN | 102307628 | A | 1/2012 |
| CN | 102462925 | A | 5/2012 |

OTHER PUBLICATIONS

NL Search Report and the Written Opinion, dated Nov. 26, 2013, 7 pages.

* cited by examiner

WEARABLE DEVICE FOR GUIDING A LINE OF A FITNESS APPARATUS

BACKGROUND

The invention relates to a wearable device for carrying out a fitness exercise, wherein the wearable device is configured to guide a line of a fitness apparatus. In particular, the wearable device is a body band to be attached to a lower or upper extremity of a person. More in particular, the wearable device is an ankle band.

FR358.494 discloses a fitness apparatus for carrying out a fitness exercise. The fitness apparatus comprises an ankle bandage. The ankle bandage comprises a strap which can be wrapped around to bind the ankle bandage to an ankle of a person. The ankle bandage includes a pulley for guiding a line of the fitness apparatus. The line is introduced through the pulley to mount line around a wheel of the pulley. The pulley is connected to the strap by a ring. The ring provides to the pulley a freedom to move in any direction, such that the pulley can follow any directions of the line during the fitness exercise.

A problem to the ankle bandage is that it does not satisfy to the requirements of nowadays users. Users require convenient and sophisticated tools to carry out their fitness exercises.

U.S. Pat. No. 3,162,441 discloses a harness for carrying out a fitness exercise. The harness comprises a fitness apparatus which includes a spring connected pulley for guiding a line. The spring of the fitness apparatus can be stretched in a length direction to provide a resistance during a training exercise. The harness can be used in combination with stirrups provided with pulleys which are adapted for the feet of a user for guiding the line from the fitness apparatus along a foot of the user.

SUMMARY OF THE INVENTION

The general object of the present invention is to at least partially eliminate the above mentioned drawbacks and/or to provide a useable alternative. More specific, it is an object of the invention to provide a wearable device for carrying out a fitness exercise which is user friendly and which allows more variations in work outs.

According to the invention, this object is achieved by a wearable device according to the claims.

The wearable device according to the invention is arranged for carrying out a fitness exercise by using a fitness apparatus. The fitness apparatus comprises a line, which may be a cord, cable, a rigid string, an elastic string etc. The wearable device is arranged for guiding such a line. In particular, the invention relates to a body band, more in particular to an ankle band. The device comprises a fastener for attaching the device to a body part of a person. Particularly, the fastener comprises a pad. The pad has an inner surface which may be made from a soft material which is convenient to wear directly to a cloth or a skin of a person. The device further comprises a base element which is connected to an outer surface of the fastener. The device further comprises a guidance element for guiding a line of the fitness apparatus. The guidance element is movable connected to the base element by a linkage member. The linkage member is situated in between the guidance element and the base element. The guidance element is movable with respect to the base element from an initial position to a working position in case that a force is exerted via the line by carrying out a fitness exercise.

The wearable device according to the invention is improved in that the linkage member comprises a resilient member. The resilient member provides a spring force when the linkage member is moved away from its initial position. The resilient member is arranged to return the guidance element back from the working position to the initial position in case that an exerted force reduces. The resilient member comprises a stopper for limiting an axial extension of the resilient member.

The wearable device according to the invention has an advantage in that the guidance element has a predetermined initial position. This is advantageous when attaching the line of the fitness apparatus to the device. The guidance element is stable in the predetermined initial position, which allows an easy connection of the line. The line can be connected to the device by using just a single hand. The predetermined initial position is further advantageous during an activity of the person. For example, during a running activity of a person who is wearing the device at his ankle, the guidance element may remain in the predetermined initial position which may prevent a disturbing flapping of the guidance element around his foot.

In an embodiment of the wearable device according to the invention, the linkage member and the resilient member are integrated into a one-piece item. The resilient member may be incorporated into the linkage member. The linkage member may be flexible. Advantageously, a simple configuration is provided by the incorporation of the resilient member into the linkage member.

In an embodiment of the wearable device according to the invention, the linkage member is oblong. The linkage member may comprise an elongated sleeve which is deflectable in a radial direction. Preferably, the sleeve is made of a plastic material. The sleeve extends from the base element to the guidance element. The linkage member has an axial axis. The proximal end of the sleeve is connected to the base element and a distal end of the sleeve is connected to the guidance element. The deflectable sleeve serves as a linkage member and additionally has an incorporated resilient member. The sleeve may comprise a full solid body or a tubular hollow body. Preferably, the sleeve comprises a spiral body which advantageously allows a controlled smooth deflection of the linkage member.

In an embodiment of the wearable device according to the invention, the linkage member has a diabolo shaped body. The diabolo shape body has in dimensions a small middle region and wider end regions. The relatively small middle region contributes to a sidewards flexibility of the linkage member which provides the resilient property, while the total body is strong enough in axial direction to prevent an undesired elongation in axial direction. The diabolo shaped body serves as a one piece item linkage member to connect the guidance element to the base element, which diabolo shaped linkage member incorporates both a resilient member to allow a movement in a radial direction and a stopper to prevent an inadmissible elongation in axial direction.

In an alternative embodiment of the wearable device according to the invention, the linkage member and the resilient member are separate items. The linkage member may comprise a linkage bar which serves as a stopper. The resilient member may be a spring. The linkage bar may be pivotally connected to the base element to allow a rotational movement of the guidance element. The spring may be connected to the linkage bar to return the linkage bar to the initial position.

In an embodiment of the wearable device according to the invention, the stopper may be incorporated in a one-piece item or arranged as a separate component. The stopper is a travel limiting means to prevent the resilient member to extend over on inadmissible distance in axial direction. The stopper is arranged to limit an axial extension of the resilient member. Advantageously, the stopper allows a lightweight configuration of the resilient member in preventing damage caused by an exerted force during a fitness exercise.

In an embodiment of the wearable device according to the invention, the stopper is arranged in parallel with the resilient member. Preferably, the stopper is arranged along a centreline of the resilient member. The stopper may be positioned inside a through hole of the resilient member. Preferably, the stopper is a wire element, like a piece of cord, which has a flexibility in a radial direction to bend together with the resilient member, but to prevent an axial inadmissible extension. The wire element may be connected in between the guidance element and the base element to limit a travel of the guidance element with respect to the base element.

In an embodiment of the wearable device according to the invention, the fastener of the wearable device defines a longitudinal axis L-L which corresponds in use with a longitudinal axis of the body part of a person. The linkage member is in the initial position preferably positioned substantially in parallel with the longitudinal axis the L-L. Substantially means that a deficiency from pure parallel of about 5° till 10° with respect to the longitudinal axis is allowable. In this arrangement, the linkage member is in the initial position aligned with an axial axis of a lower or an upper extremity of a person. The linkage member extends in a direction from a lower region to an upper region of the fastener. In case of a wearable device arranged as an ankle band this initial position corresponds with a vertical direction when a person who is wearing the ankle band is in a standing position. The guidance element is movable from the initial position to a working position. In particular, the working position is reached after a deflection of the guidance element away from the longitudinal axis L-L. In the working position, the guidance element and the axial axis of the linkage member are positioned under an angle with respect to the longitudinal axis L-L. In particular, an acute angle in between an centre axis from a base and a top of the linkage member and the longitudinal axis L-L is at least 15°, in particular at least 30°, more in particular at least 45°. Such an arrangement is in particular advantageous in a situation in which the wearable device is attached as an ankle band to an ankle of the person and wherein the line of the fitness apparatus extends during an exercise from the hip, via the ankle to a hand of the person. In this arrangement, the line can smoothly run along the guidance element and the linkage member. The linkage member may form a suspension which may smoothly compensate for occurring forces during the fitness exercise.

In an embodiment of the wearable device according to the invention, the device comprises a locking element for locking the guidance element in its initial position. The locking element comprises a first and a second locking member. The first locking member is positioned at the base element opposite the movable guidance element to engage with the second locking member at the linkage member or guidance element when the guidance element is positioned in its initial position. Advantageously, the locking element retains the guidance element in its initial position during activities to prevent a disturbing swing of the suspended guidance element.

In an embodiment of the wearable device according to the invention, the locking element comprises a magnetic locking element. The magnetic locking element generates a magnetic field which provides a magnetic region in which the guidance element can be captured to bring the guidance element to a steady position. Advantageously, in comparison with a mechanical locking element including a pair of a groove and a ril or a pair of a recess and a complementary elevation, such a magnetic locking element provides a larger region to capture the guidance element.

In an embodiment of the wearable device according to the invention, the guidance element comprises a guidance member, in particular a guidance wheel for guiding a line. Advantageously, the guidance wheel provides a smooth guidance of a line of a fitness apparatus. The guidance wheel has a circumferential running surface for guiding the line of the fitness apparatus. The circumferential running surface has preferably a sunken running track for encompassing the line. Preferably, the guidance wheel is provided with wheel flanges to prevent the line from running of the guidance wheel.

In an embodiment of the wearable device according to the invention the guidance element comprises a holder. A single sided connection is provided for connecting the guidance member to the holder. The guidance member is connected by the single sided connection to the holder. Preferably, the holder is L-shaped. The guidance member has a single sided suspension. Particularly, the guidance wheel is at only one flange side connected to the holder. The opposite flange side of the guidance wheel is than free from a connection component, such that an access is provided for receiving a line of the fitness apparatus. Advantageously, the user may frequently and easily connect and disconnect a line of the fitness apparatus to and from the guidance member. Advantageously, a user may tidy up the fitness apparatus including the wearable device in a very efficient and ordered manner. Especially, in case that the fitness apparatus comprises a winding device which is arranged to wind up the line, it is advantageous that the line can be quickly disconnected from the wearable device to quickly tidy up all the equipment.

It is remarked that this aspect regarding the single sided connection at a flange of the guidance wheel is considered patentable as such, which results in an embodiment of the wearable device for carrying out a fitness exercise by using a fitness apparatus, wherein the device comprises a fastener for attaching the device to a body part of a person, a base element which is connected to the fastener, a guidance element including a guidance member for guiding a line of a fitness apparatus, wherein the guidance member is a guidance wheel including a first and a second wheel flange, wherein the guidance wheel has a single sided connection to a holder, wherein the guidance wheel is connected at the first wheel flange to a holder, while the second wheel flange remains accessible for receiving a line of a fitness apparatus. Advantageously, a line can be quickly and frequently be connected and disconnected to the wearable device.

In an embodiment of the wearable device according to the invention, the guidance element comprises a cap. The cap is connected to the guidance member at a side opposite the single-sided connection. The cap is connected at the free side of the guidance member. The cap comprises a protruding finger at an outer contour. The protruding finger extends beyond an outer contour of the guidance member. The protruding finger is arranged for hooking a line of a fitness apparatus. The protruding finger may advantageously prevent an undesired premature disconnection of the line from the guidance member.

According to the invention, a fastener should be interpreted in a broad sense. A fastener serves to attach the wearable device to a person's body part. In an embodiment of the wearable device according to the invention, the fastener is a wraparound pad. The wraparound pad comprises at least one belt to fasten the pad at a body part.

In an alternative embodiment of the wearable device according to the invention, the fastener is an elastic band. The elastic band may be closed in a circumferential direction. By stretching the elastic band, the wearable device may be attached to a person's body part.

In an alternative embodiment of the wearable device according to the invention, the fastener is a cloth. The fastener may be shaped as a glove, a sock or a shoe.

Further, the invention relates to a wearable device in which the base element is releasable connected to the fastener. The fastener can be worn as a separate item. The wearable device may be provided with a snap fit connection of the base element to the fastener.

Further the invention relates to the fastener as such, in particular a sock, wherein the fastener is configured to be worn in combination with the wearable device according to the invention. The fastener is wearable at a body part apart from the wearable device. The fastener can be put on in a first step, wherein the wearable device is attached in a next step onto the fastener to obtain an assembled condition of the wearable device. The fastener has an attach portion which is arranged for an attachment with the wearing device. After attaching the wearable device to the fastener, the attach portion is in engagement with the wearable device. Preferably, the fastener has a pad shaped attach portion. The pad shaped portion is protruding. The pad shaped attach portion has a thickness which is larger than a thickness of the remaining portion. In case that the wearable device comprises an ankle band, the pad shaped attach portion is arranged to fit at an ankle of a person. In particular, the attach portion includes a soft area. The soft area is provided at an inner side of the fastener to reduce binding stresses to a body part, in particular an ankle zone.

In an embodiment of the fastener according to the invention, the fastener comprises a pair of a left and right fastener. The left fastener is arranged in mirror symmetry with the right fastener.

In an embodiment of the fastener according to the invention, the fastener is sleeve shaped. Particularly, the fastener is arranged to fit around a foot of a person. Preferably, the fastener is sock shaped. The sock shaped fastener may have an open toe-end and/or open heel-end.

In an alternative embodiment of the wearable device according to the invention, the fastener may be a clip for clipping the wearable device to a cloth, e.g. a shoe of a person.

In an embodiment of the wearable device according to the invention, the base element bridges a distance in between the inner surface of the fastener and a centre of the guidance member of at least 20 mm, in particular at least 25 mm, but preferably at least 30 mm. Advantageously, in use of the fitness apparatus such a distance spaces the line from a person's body part, which may prevent a contact of the line with a person's body during an exercise. Tests have revealed that contacts of the line and the body parts can be strongly reduced from at least 25 mm.

The invention also relates to a fitness apparatus.

BRIEF DESCRIPTION OF THE DRAWINGS

The invention will be explained in more detail with reference to the appended drawings. The drawings show a practical embodiment according to the invention, which may not be interpreted as limiting the scope of the invention. Specific features may also be considered apart from the shown embodiment and may be taken into account in a broader context as a delimiting feature, not only for the shown embodiment but as a common feature for all embodiments falling within the scope of the appended claims, in which:

DETAILED DESCRIPTION

Figure 1A:
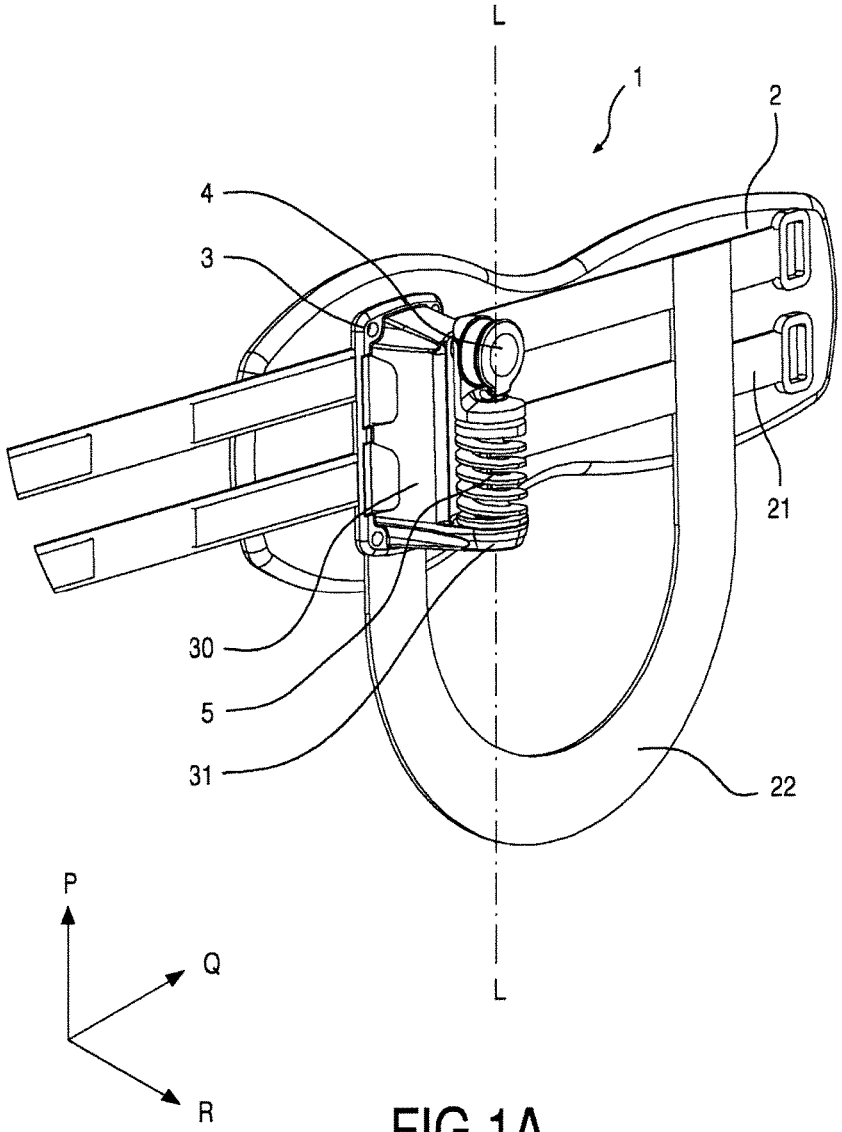
FIG. 1A shows a perspective view of an embodiment of the wearable device according to the invention.
Figure 1B:
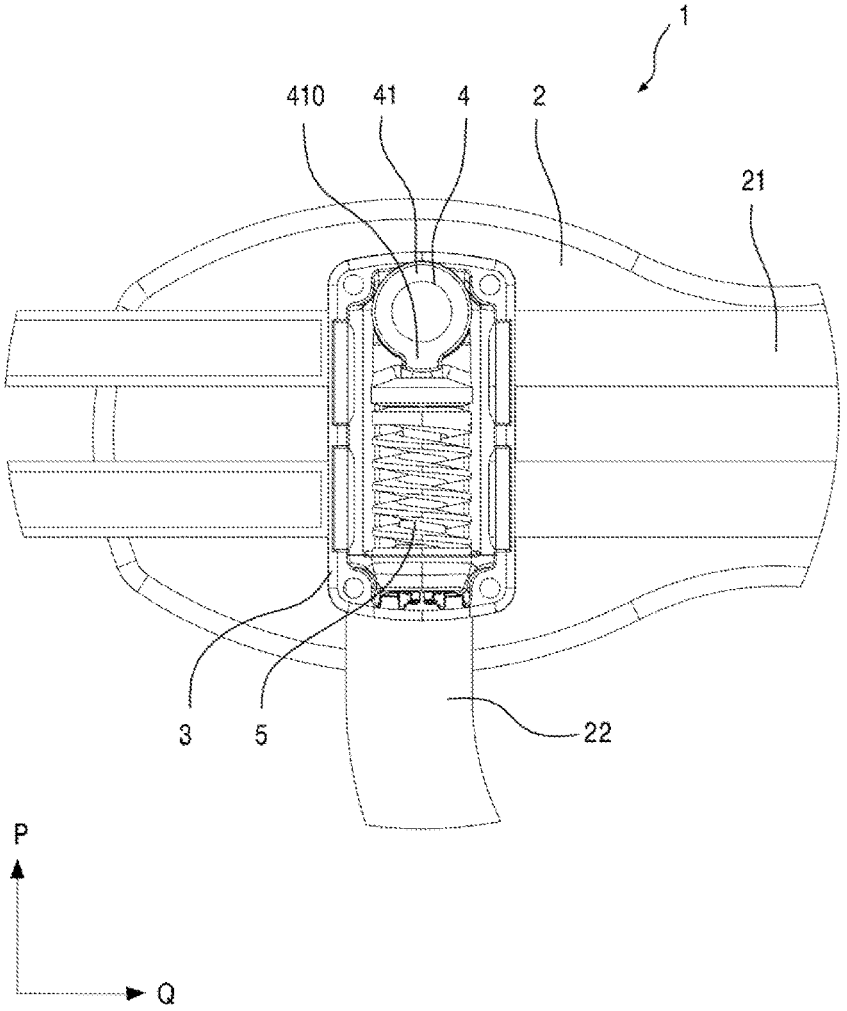
FIG. 1B shows the wearable device of FIG. 1A in a front view.
Figure 1C:
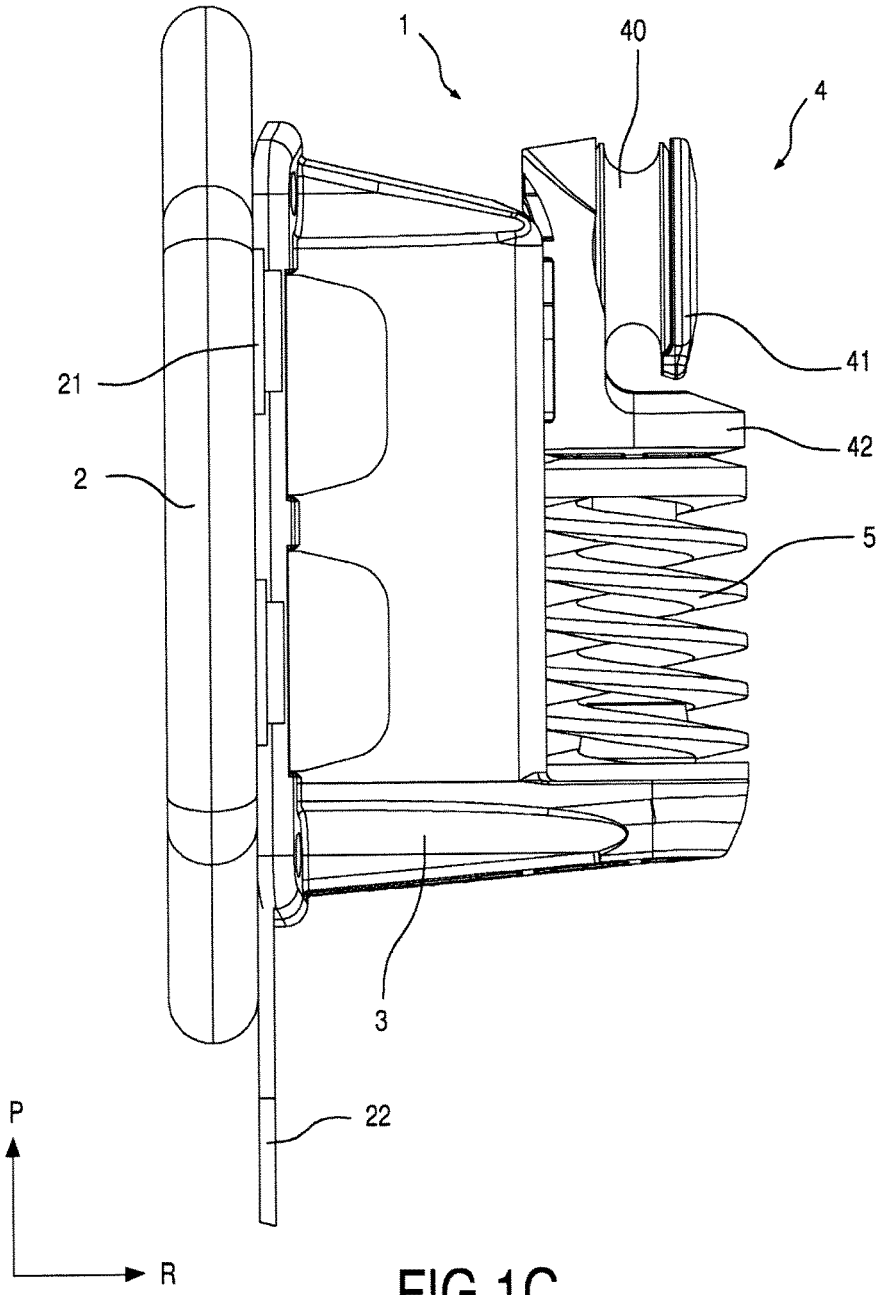
FIG. 1C shows the wearable device of FIG. 1A in a side view.

FIG. 1A shows in a perspective view an embodiment of a wearable device, in particular a body band 1, according to the invention. The body band 1 is further illustrated in a front, side, top and cross-sectional view in respectively FIG. 1B-1E. Identical reference numbers indicate corresponding components of the body band. To facilitate comprehension of the description and of the claims the words vertical, horizontal, longitudinal, cross-sectional—with reference to the gravity and to the ordinate system P,Q,R shown in the drawings—are used in a non-limiting way.

The body band is configured to be worn at a body part of a person. The body band can be positioned at a lower or upper extremity of a person, in particular at a wrist, elbow, knee or ankle. The body band has a pad 2 including an inner surface, which softens the attachment of the body band to a body part. The pad may be a closed elastic band or shaped as a sock as shown in FIG. 2. The illustrated pad 2 is a wraparound pad which is closable by at least one closure belt 21. The closure belt 21 is connected to the pad 2. The closure belt 21 is stitched to the pad 2. The closure belt 21 is attached to an outer surface of the belt. A pair of belts 21 is provided to wrap and close the pad around a body part.

The illustrated body band is configured as an ankle band. The ankle band further has a foot belt 22. The foot belt 22 is configured to be attached to a heel of a person. The foot belt 22 extends at a downside of the pad 2 of the ankle band. The foot belt 22 extends in a direction traverse to the closure belt 21. The foot belt 22 is a loop shaped belt which can be attached to a heel of a person. A person may put his heel into the foot belt of the ankle belt. The wearable device defines a longitudinal axis L-L. The longitudinal axis L-L of the wearable device extends in use in a direction in parallel with a central axis of an extremity, in particular a lower leg, of a person. The foot belt 22 prevents the ankle band from shifting upwards along the longitudinal axis L-L in case that a longitudinal force is exerted onto the ankle band. Additionally, the foot belt 22 allows a less tight connection of the closure belt 21 in use which increases the comfort of the ankle band.

The ankle band 1 further comprises a base element 3. The base element 3 is a rigid component. The base element has a back side which is connected to the pad 2. The base element 3 is connected to an outer surface of the pad 2. The base element 3 is an injection moulded item. The base element 3 has a base body 30 which is substantially block shaped. The base element 3 comprises at a front side a support 31 for connecting a guidance element 4. The support 31 protrudes from the base body 30. The support 31 is positioned at a lower region of the base body 30. The support 31 has a cylindrical protrusion 311 for positioning a linkage member 5.

The ankle band further comprises a guidance element 4. The guidance element 4 includes a guidance wheel 40 for guiding a line of a fitness apparatus. The guidance wheel has a circumferential running surface for guiding the line. The line can be placed around the running surface from an accessible side of the guidance wheel 40. At only one side, the guidance wheel is connected to a holder 42 of the guidance element. The holder 42 is L-shaped and includes an upstanding and a base leg. The holder 42 has at the upstanding leg a cylindrical protrusion 44 for journaling the guidance wheel 40. The guidance wheel 40 has a single sided connection to the upstanding leg of the holder 42. The single sided connection allows an access from the front side of the wearable device to the guidance wheel for frequently and quickly placing the line of the fitness apparatus. Opposite the single sided connection, the guidance wheel 40 comprises a cap 41. The cap 41 covers a side face of the guidance wheel 40. The cap 41 has a protruding finger 410 which extends in particular downwards in the longitudinal direction L-L of the ankle band. The protruding finger 410 extends in a radial direction with respect to the guidance wheel 40. The protruding finger 410 is provided to help placing the line and to limit a space in between the guidance wheel 40 and the base leg of the holder 42 after a line is placed to prevent the line from escaping from the guidance wheel.

The guidance element 4 is connected to the base element 3 by a linkage member 5. The linkage member 5 enables the guidance element 4 to move away from an initial position. The linkage member 5 allows the guidance element 4 to move in at least two rotational degrees of freedom. The linkage member 5 allows the guidance element 4 to move from the initial position to a working position in case that a force is exerted by the line of the fitness apparatus on the guidance element 4. The initial position is substantially in parallel with the longitudinal axis L-L. The working position is a deflected position with respect to the longitudinal axis L-L. The linkage member 5 comprises a resilient member to return the linkage member 5 back to the initial position.

The linkage member 5 may include a rigid body as a stopper for connecting the guidance element 4 at a distance from the base element 3, wherein the linkage member further comprises a separate spring as a resilient member 51. The rigid body may be arranged as a bar which is pivotally connected to the base element 3, wherein the separate spring exerts a spring force to bring the rigid body in an initial position.

Figure 1D:
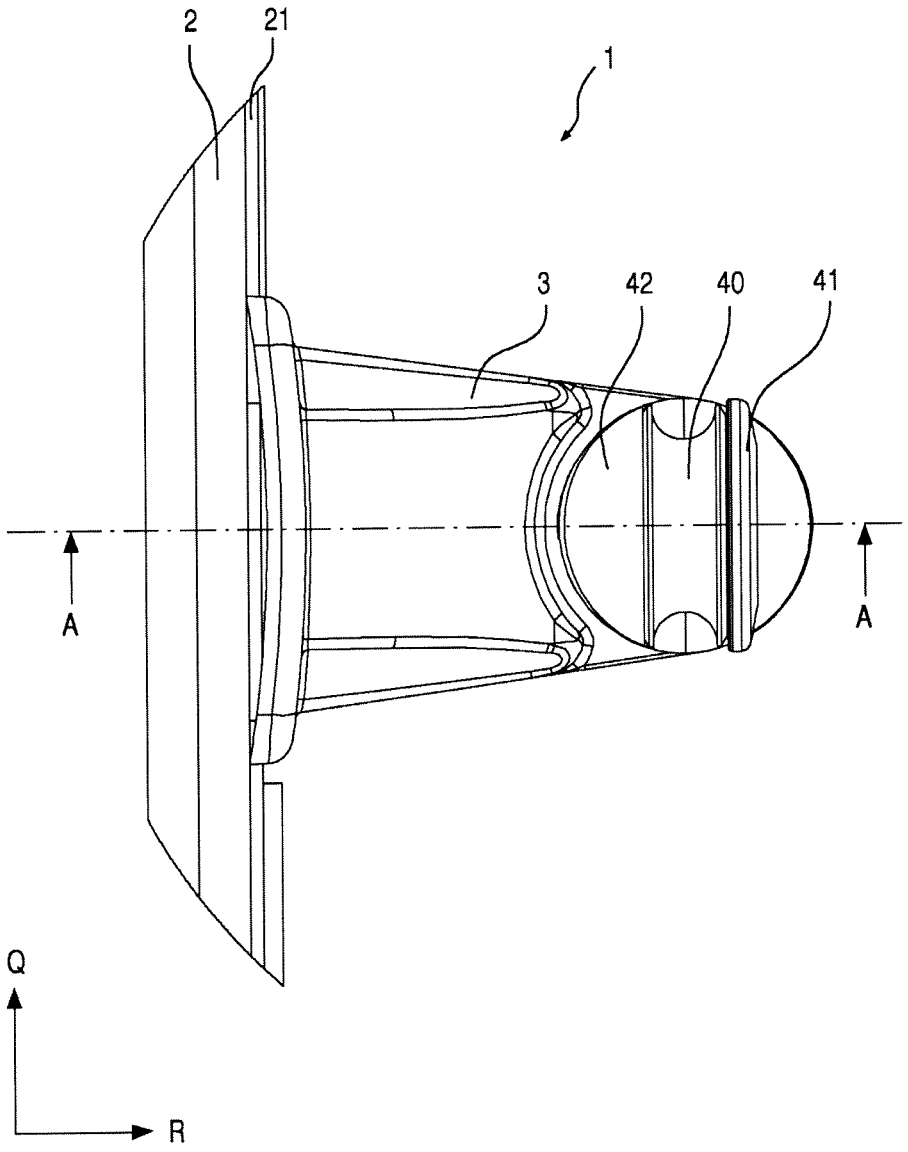
FIG. 1D shows the wearable device of FIG. 1A in a top view.
Figure 1E:
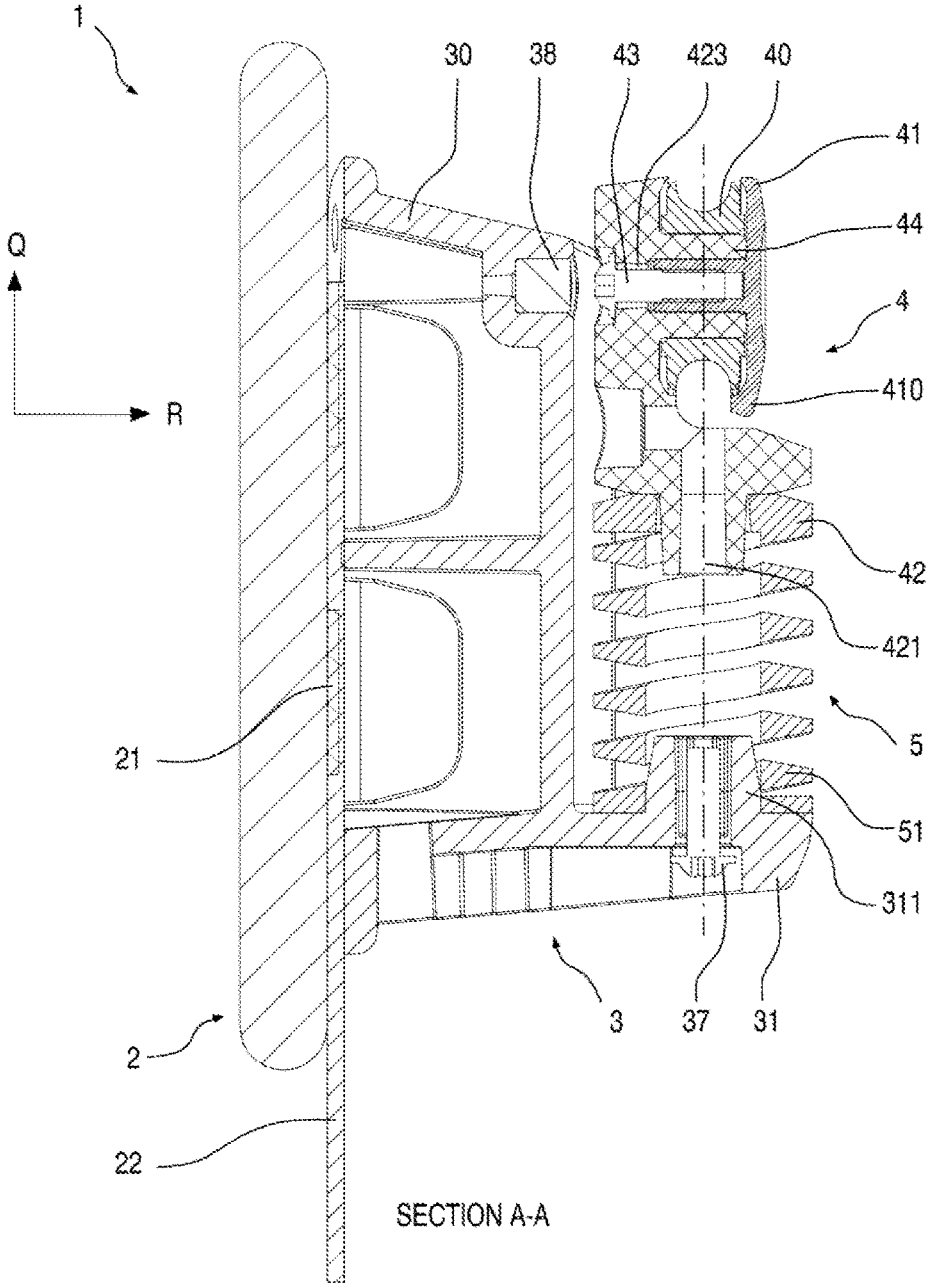
FIG. 1E shows the wearable device of FIG. 1A in a cross-sectional view.
Figure 1F:
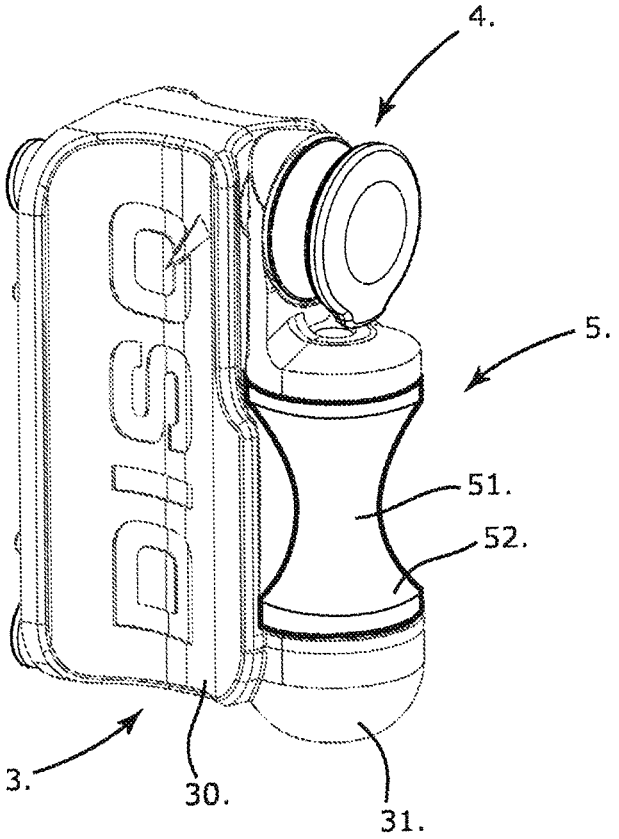
FIG. 1F shows an embodiment of the wearable device in a perspective view, wherein the linkage member has a diabolo shape.

In the illustrated embodiment of FIG. 1E, the linkage member 5 is flexible and has an incorporated a resilient member 51. The linkage member 5 and the resilient member 51 are integrated into a one piece item. The resilient member 51 is sleeve shaped. The resilient member 51 has an elongated body. In particular, the elongated body is hollow. The elongated body has an axial axis. The axial axis of the resilient member 51 is in the initial position positioned substantially parallel to the longitudinal axis L-L of the wearable device. In FIG. 1E, the resilient member 51 has a resilient spiral body. The spiral body comprises a plurality of windings which are compressible towards each other. In comparison with a solid body, the spiral body makes the resilient member more bendable. In FIG. 1F, the linkage member 5 comprises an integrated resilient member 51 and an integrated stopper 52. The linkage member comprises a diabolo shaped body. The diabolo shaped body is elongated. The diabolo shaped body has a first end which is connected to the support 31 of the base element 3 and a second end which is connected to the holder 42 of the guidance element 4. The diabolo shaped body has a relatively slim middle region with respect to the end portions which provides flexibility in a sidewards radial direction. Herewith, the resilient member 51 is incorporated in the linkage member 5. The diabolo shaped body provides rigidity in a longitudinal direction to prevent an inadmissible movement of the guidance element 4 in the axial direction. Herewith, the stopper 52 is incorporated in the diabolo shaped body. Hence, the linkage member 5 incorporates both the resilient member 51 and the stopper 52 and a one piece item.

In the embodiment of the wearable device as shown in FIG. 1E, the linkage member 5 comprises a stopper (further shown in FIG. 1H) as a separate item. The stopper compensates an axial force exerted onto the linkage member. The stopper may prevent a damage to the resilient member 51 caused by an inadmissible large axial force. The stopper is a flexible element, in particular a wire element, such as a cord. Here, the stopper is mountable about a central axis of the linkage member 5. The resilient member 51 has a central through hole as a passageway for the stopper. A first end of the stopper is connected via the support 31 to the base element 3 by a clamp connection 37 and a second end of the stopper is connected to the holder 42 of the guidance element 4. The second end of the stopper is connected by a form closure to the base leg of the holder 42. The clamp connection 37 is positioned in a middle region of the base element 3. As shown in FIG. 1E, the clamp connection may alternatively positioned at the support 31 of the base element.

Figure 1G:
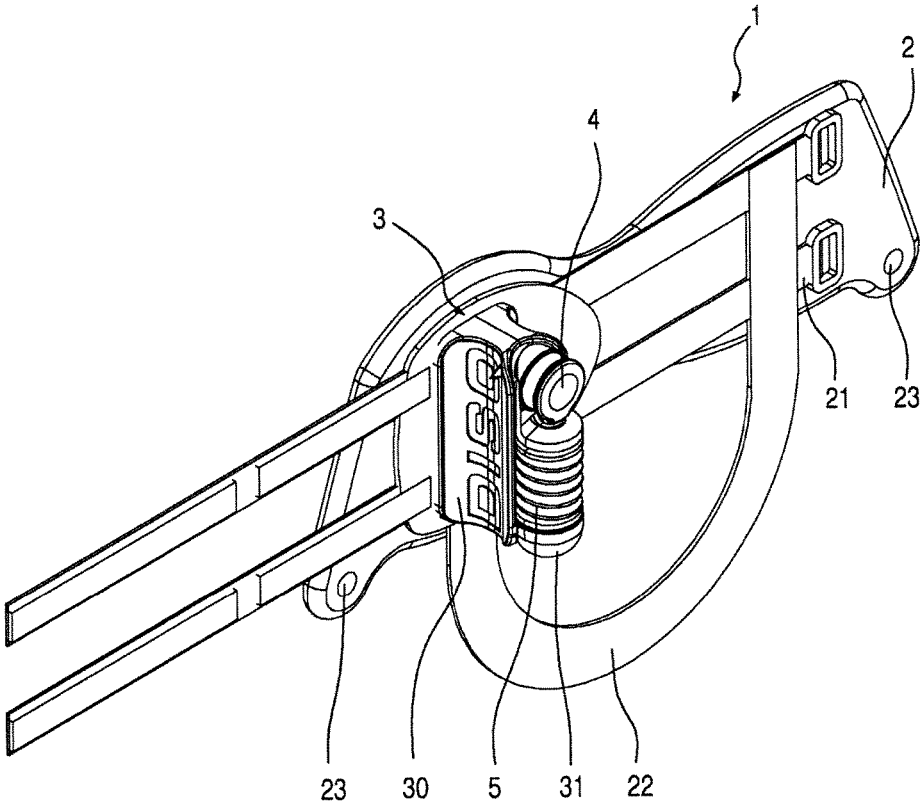
FIG. 1G shows a perspective view of an alternative embodiment of the wearable device according to the invention.
Figure 1H:
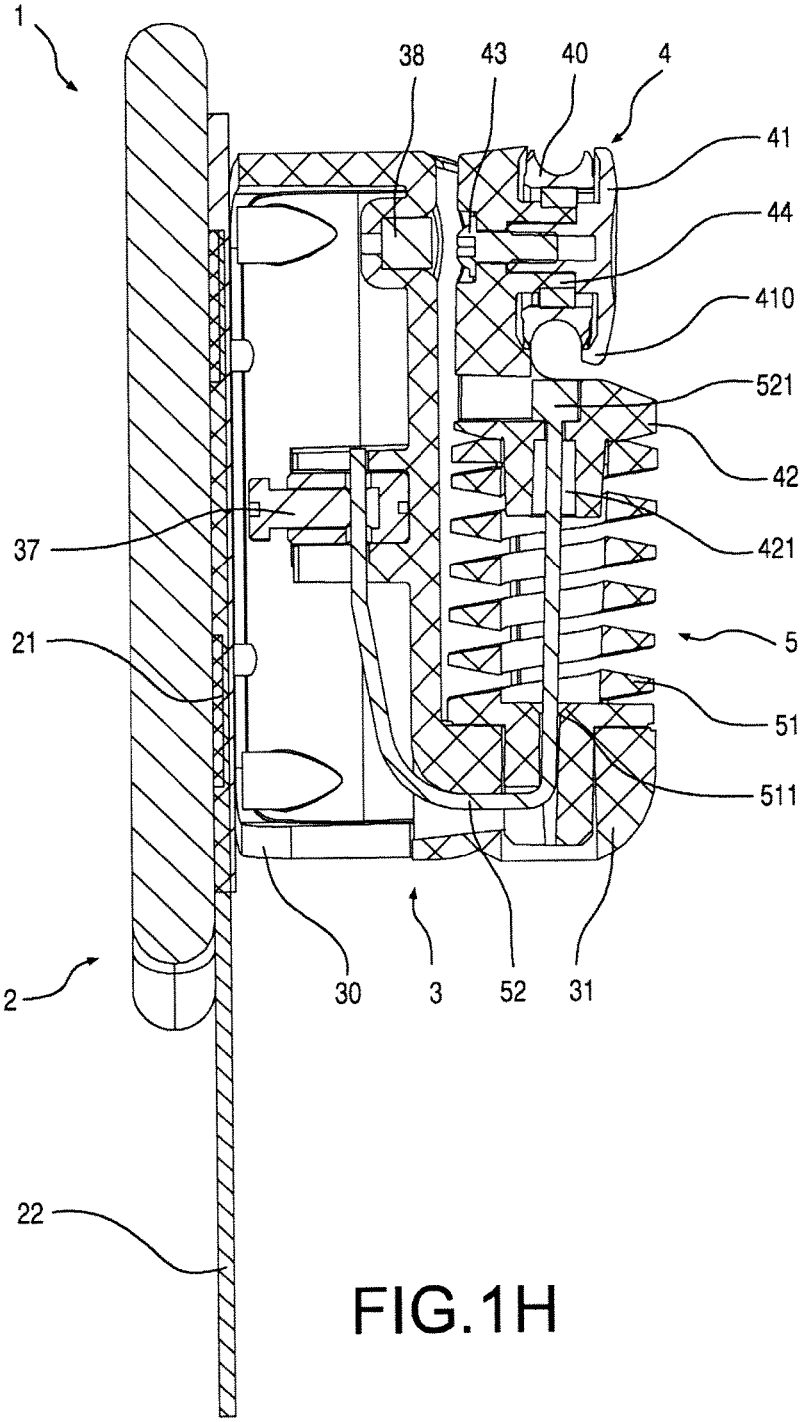
FIG. 1H shows the wearable device of FIG. 1G in a cross-sectional view.

FIG. 1E shows a cross-sectional view of the ankle band about a section line A-A as shown in FIG. 1D. As illustrated in the cross-sectional view of FIG. 1E, base body 30 comprises a locking element 38 for locking the guidance element 4 at a predetermined initial position. The locking element 38 is positioned opposite the guidance element 4. Particularly, the locking element 38 is aligned with a rotational axis of the guidance element 4. The locking element 38 has a first and second locking member. In particular, the locking element 38 has a first and second magnetic locking member. In the initial position, the first magnetic member is positioned opposite the second magnetic member which second magnetic member is connected to the guidance element 4 to position and maintain the guidance element with respect to the base element 3. In the initial position, the first magnetic member is aligned with the second magnetic member. The first magnetic member is a magnet piece which is mounted to the base element 3. The second magnetic member 43 is here a screw 423. The screw 423 is positioned at a central axis of the guidance wheel. The screw 423 is connected to the cap 41 to mount the guidance wheel 40 in axial direction. FIG. 1G shows a perspective view of an embodiment of the wearable device according to the invention which is adapted in some aspects. FIG. 1H shows the wearable device of FIG. 1G in a cross-sectional view.

The wearable device has a fastener 2 which comprises a pad. The pad is arranged as illustrated in FIG. 1A and includes a foot belt 22. The pad further comprises at least one through hole 23. The at least one through hole 23 is positioned adjacent an outer edge of the pad. The at least one through hole is positioned at a lower region of the pad. The at least one through hole serves to connect the pad to another wearable piece. The at least one through hole may be used to connect the pad to a shoe of a user. A shoelace may be laced through the at least one through hole to connect the pad to the shoe. This may further prevent a shifting of the pad along a leg of a user. The at least one through hole 23 may substitute the foot belt 22.

The wearable device has a base element 3 which is connected to the pad 2. The base element 3 has a base body 30. The base body 30 is block shaped. A back side of the base body is connected to the pad 2. The base body 30 has a left and right side which defines a predetermined height of the base element 3. Herewith, the base element 3 spaces a guidance element 4 at a predetermined distance of at least 20 mm from the inner surface of the pad 2 to prevent contact of a guided line with a body part of a user. Additionally, the left and right side include a sufficient large area to provide an exposure side. The exposure side is suitable to expose information. In this case the exposure sides are labelled with a trademark name 'DISQ'.

At a front side, the base body 30 is provided with a support 31. The support is arranged to support a linkage member 5 and a guidance element 4. The guidance element 4 is connected to the support 31 by the linkage member 5. The linkage member 5 is elastically bendable and incorporates a resilient member 51. The linkage member 5 is connected to the support 31 by a pin-hole connection. A protrusion of the linkage member 5 forms a pin which is received into a hole of the support 31. The linkage member 5 comprises a stopper 52 to prevent a disconnection of the linkage member 5 from the base element 3. The stopper 52 permits a bending deflection of the linkage member 5, but prohibits a displacement of the linkage member 5 about its longitudinal axis with respect to the base element 3.

The stopper 52 is a wire element. Here, the stopper is a piece of cord. The stopper 52 is connected at one end by a clamp connection and at a second end by a form closure which allows a simple and reliable one end assembly. Here, the stopper 52 has a first end which is connected to the base element 3. The first end of the stopper 52 is clamped to the base element 3 by a clamp connection 37. The clamp connection 37 is positioned inside an inner space of the base body 30. The stopper 52 extends from the base element 3 through a guidance channel 511 of the linkage member 5. Here, the stopper 52 additionally connects the guidance element 4 to the linkage member 5. The stopper 52 is at a second end connected to the holder 42 of the guidance element 4. The linkage member 5 is captured in between the guidance element 4 and the base element 3 by the stopper 52. The holder 42 has a passageway 421 for guiding the stopper 52. The passageway is in a subassembly of the guidance element 4 and the linkage member 5 in alignment with the guidance channel 511 of the linkage member 5. The second end of the stopper 52 is connected to the guidance element 4 by a form closure. The form closure is established in that the second end includes a thickened portion 521 which is in abutting engagement with a narrowing portion in the passageway of the holder 42. The narrowing portion blocks the thickened portion in the passageway. Herewith, the guidance element 4, the linkage member 5 and the base element 3 are connected by the stopper 52 to each other in a simple manner.

Figure 1I:
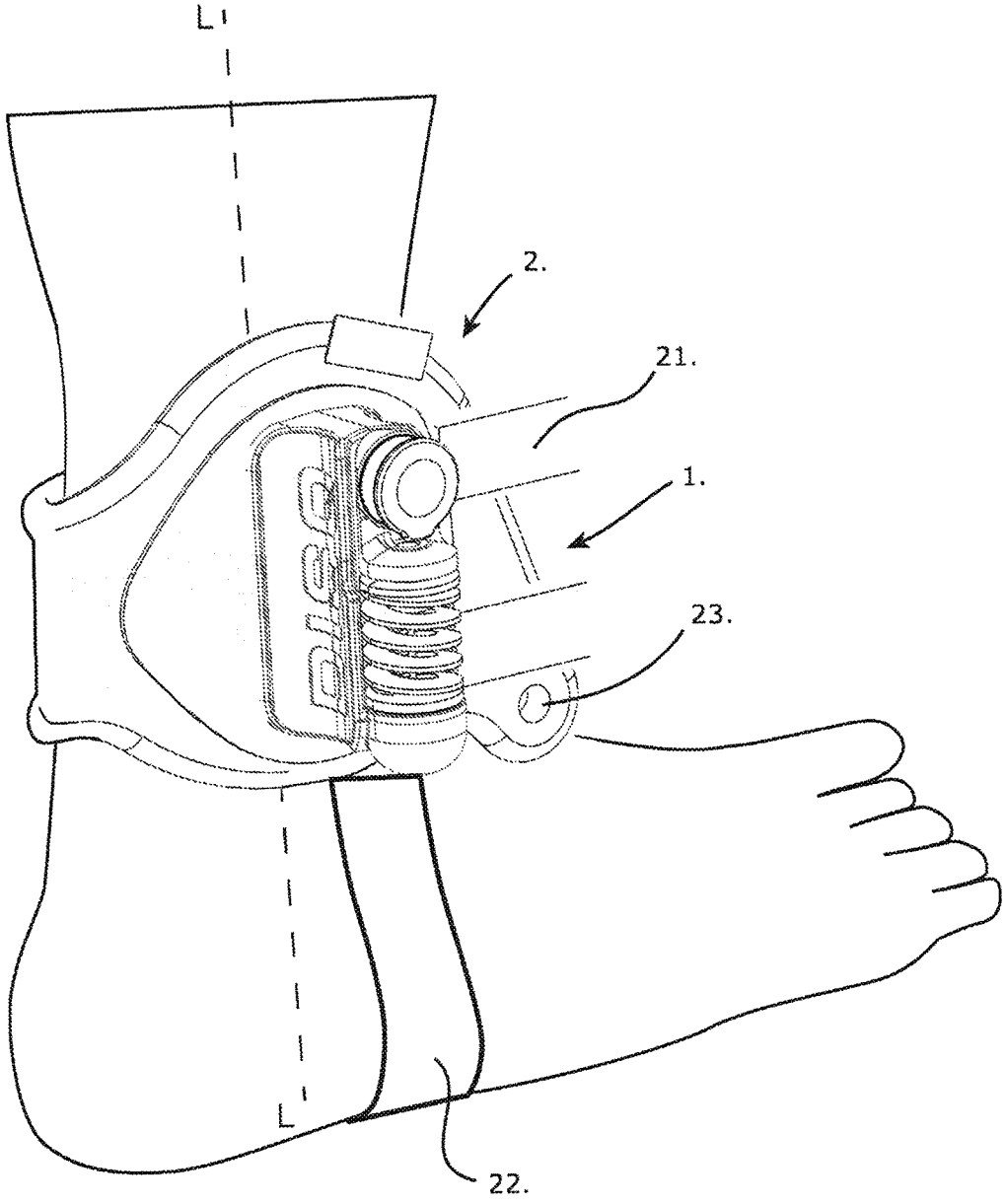
FIG. 1I shows a perspective view of the wearable device attached to a foot of a person.

FIG. 1I shows in a perspective view the wearable device 1 which is attached to an ankle of a person. The wearable device 1 comprises a pad shaped fastener 2 to fasten the wearable device 1. To closure belts 21 can be wrapped around the ankle to fasten the wearable device 1. The wearable device 1 has a foot belt 22 which extends underneath the foot of the person. The foot belt 22 is strip shaped. When wearing shoes, the wearable device 1 can be connected to the shoes by fastening the laces to the through holes 23 provided in the fastener 2.

Figure 2A:
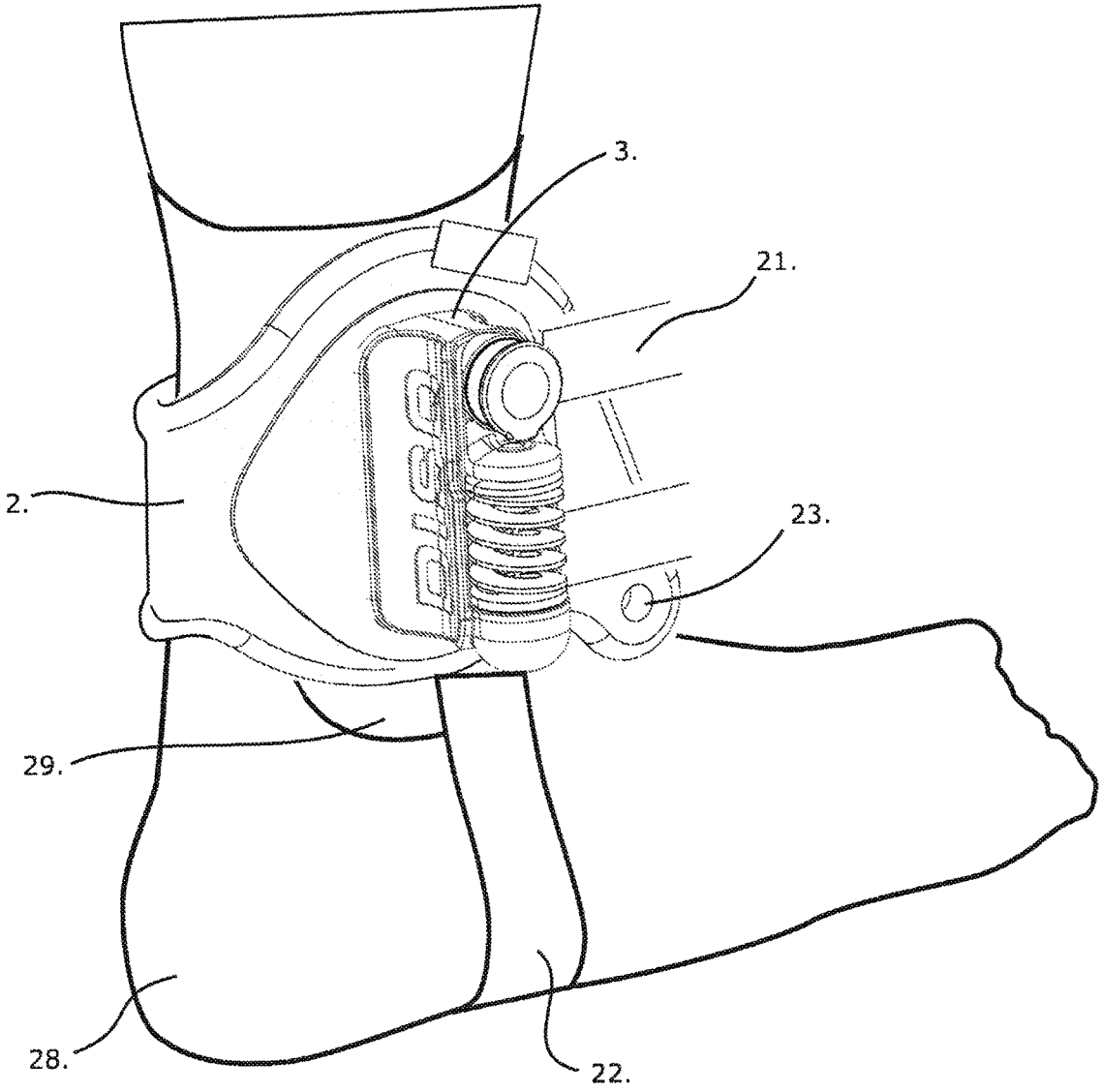
FIG. 2A shows a perspective view of the wearable device including a sock for attaching the device to an ankle.
Figure 2B:
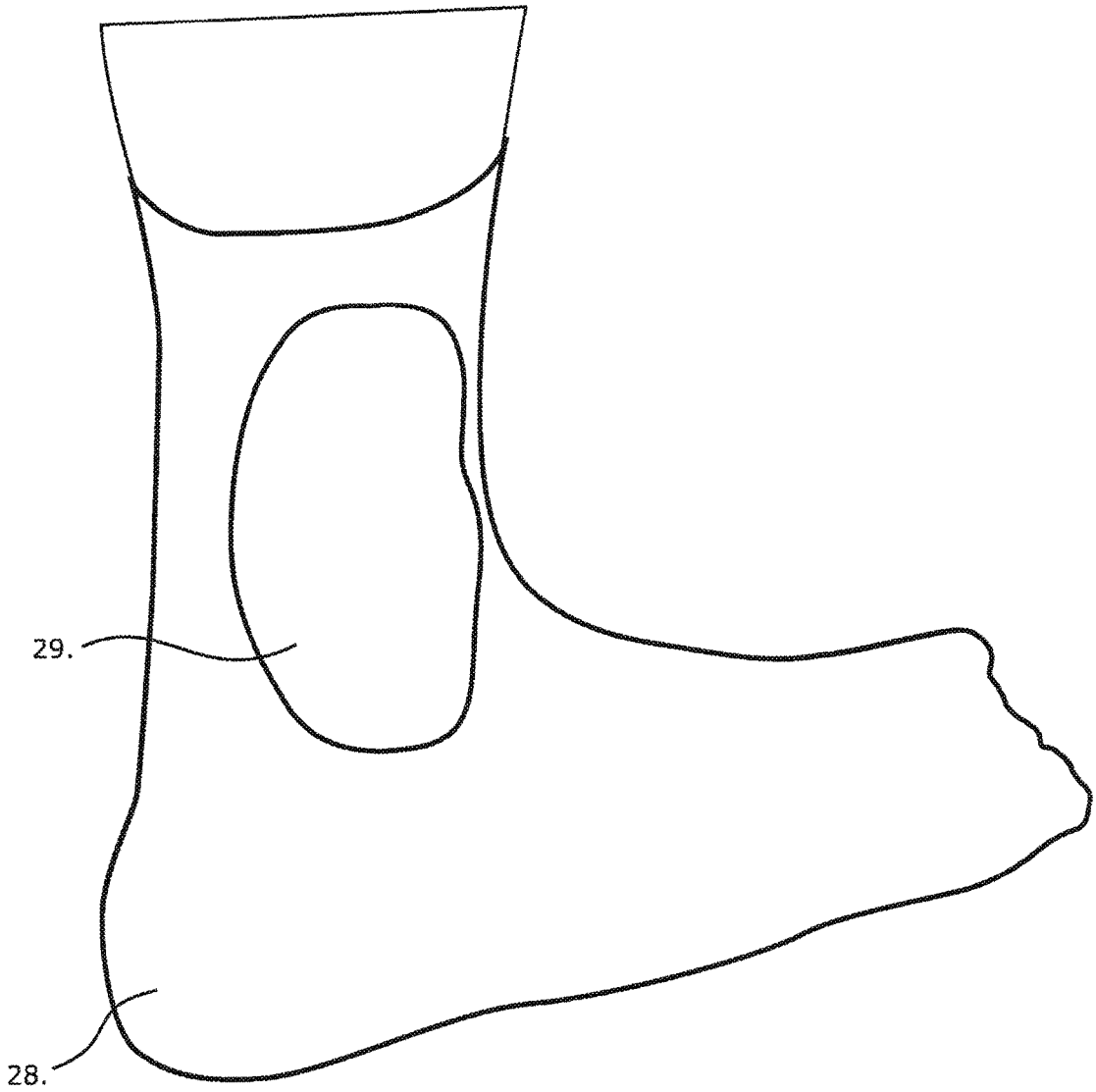
FIG. 2B shows a perspective view of the sock being worn as a separate item.

FIG. 2A shows in a perspective view a sock 28 for use in combination with the wearable device according to the invention. The sock is configured to provide a comfortable attachment of the wearable device 1 to an ankle of a person. The wearable device 1 has an ankle band configuration including a wraparound pad 2 which is connected to the base element 3. An assembly of the fastener 2 comprises the sock 28 and the wraparound pad 2 of the wearable device. The sock 28 is releasable from the base element 3 and can be worn as a separate item as shown in FIG. 2B. The wraparound pad 2 may have a Velcro or a snap-on connection to the sock 28.

The sock 28 has a thickened pad shaped portion 29 which is positioned at an outer side of the sock at ankle height to engage the pad of the wearable device. The pad shaped portion 29 protrudes from the remaining portion of the sock 28. The pad shaped portion 29 of the sock 28 is arranged to engage with the wearable device. The pad shaped portion contributes to more comfort. In particular, the pad shaped portion 29 has a size including a height dimension (seen in a longitudinal direction L-L of the sock) which substantially corresponds with a height dimension of the wearable device 1. Substantially means that the height dimension of the pad shaped portion 29 is at most 1 cm, in particular 0.5 cm larger than the height dimension of a wraparound pad 2 of the wearable device 1.

In an embodiment of a pair of socks the pair of socks comprises a left sock to be worn to a left foot and a right sock to be worn at a right foot. In a preferred embodiment of a pair of socks, the left and right socks have the same configuration in that both socks comprises a first and second pad shaped portion at ankle height at an inner and an outer side of the sock. In an alternative embodiment, the pad shaped portion 29 has a band configuration. The band extends around a whole ankle area of a sock. In FIG. 2A, the foot belt 22 which is connected to the wraparound pad 2 extends across the sock. The foot belt 22 extends across a foot portion of the sock 28.

Figure 2C:
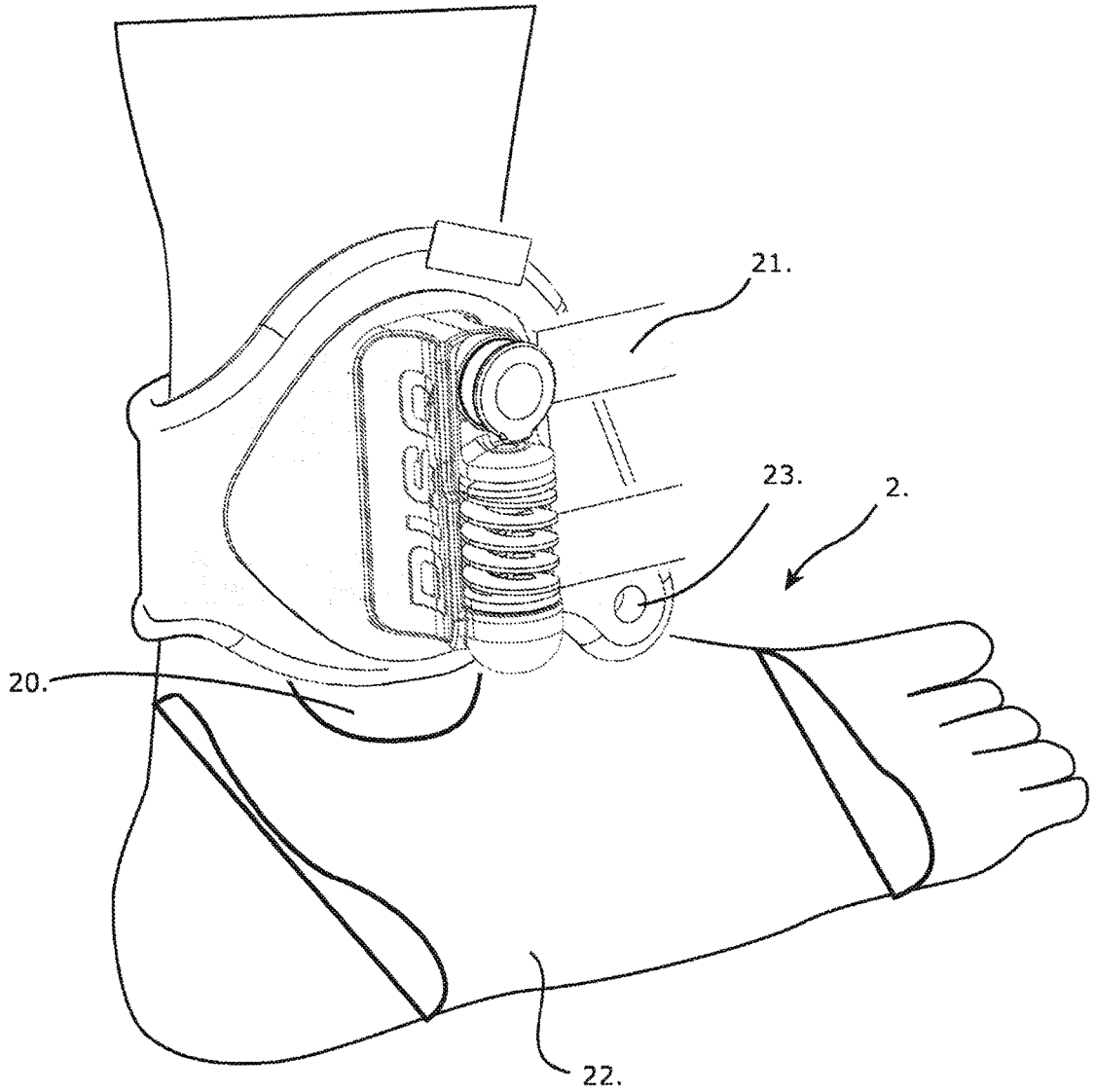
FIG. 2C shows the sock of FIG. 2A as an integrated item of the wearable device.

FIG. 2C shows in a perspective view an embodiment of the fastener 2, wherein the foot belt 22 is incorporated in a lower region of the sock 28. The incorporated foot belt 22 is a strengthened area of the sock to compensate for occurring forces during a fitness exercise. The sock 28 including the strengthened area is arranged to compensate for occurring forces in a longitudinal direction L-L of the body part. The wearable device 1 is fixedly connected to the sock 28. The wearable device 1 is sewed to the sock 29. The wearable device 1 comprises a wraparound pad 2 to strengthen a fixture of the wearable device 1 to a person's foot. As illustrated in FIG. 2C, the sock 28 has an open toes zone and an open heel zone.

Numerous variants are possible in addition to the illustrated embodiment. The pad of the body band is illustrated as a strip shaped wraparound pad. However, it is explicitly expressed that also a pad in form of a cloth like a sock or a shoe, a shoe clip or a closed circumferential band falls within the scope of the appended claims. Said body band and in particular said pad has to be interpreted in a broad sense as an attachment means for wearing a device to a body part.

Although the invention has been disclosed with reference to particular embodiments, from reading this description those of skilled in the art may appreciate a change or modification that may be possible from a technical point of view but which do not depart from the scope of the invention as described above and claimed hereafter. Modifications may be made to adapt a particular situation or material to the teachings of the invention without departing from the essential scope thereof. It will be understood by those of skilled in the art that various changes may be made and equivalents may be substituted for elements thereof without departing from the scope of the invention. Therefore, it is intended that the invention is not limited to the particular embodiments disclosed in the above detailed description, but that the invention will include all embodiments falling within the scope of the appended claims.

Thus, the invention provides a wearable device for guiding a line of a fitness apparatus for carrying out a fitness exercise, wherein the device comprises a resilient member to return a guidance element from a working position to an initial position. This is advantageous, because it allows a quick single hand release of the line of the fitness apparatus from the wearable device. Further, it is advantageous that the guidance element remains in a stable position during activities. Disturbances caused by a freely swinging guidance element are minimised.

The invention claimed is:

1. A wearable device (1), in particular a body band (1), for carrying out a fitness exercise, wherein the device comprises a fastener (2) for attaching the device (1) to a body part of a person, a base element (3) which is connected to an outer surface of the fastener (2), and a guidance element (4) for guiding a line of a fitness apparatus, wherein the guidance element (4) is movably connected to the base element (3) by a linkage member (5), such that the guidance element (4) is movable with respect to the base element (3) from an initial position to a working position when a force is exerted via the line by carrying out the fitness exercise, wherein the linkage member (5) comprises a resilient member (51) which is configured to return the guidance element (4) from the working position to the initial position when the force is omitted, wherein the resilient member (51) comprises a stopper (52) for limiting an axial extension of the resilient member (51).

2. The wearable device according to claim 1, wherein the linkage member (5) and the resilient member (51) are integrated into a one-piece item.

3. The wearable device according to claim 1, wherein the resilient member (51) is an elongated sleeve.

4. The wearable device according to claim 1, wherein the resilient member (51) comprises a spiral body.

5. The wearable device according to claim 1, wherein the resilient member (51) comprises a diabolo shaped body.

6. The wearable device according to claim 1, wherein the fastener (2) of the wearable device (1) defines a longitudinal axis which corresponds in use with a longitudinal axis of a body part to which the fastener (2) is attached, wherein the linkage member (5) is positioned in the initial position substantially in parallel with the longitudinal axis of the fastener and wherein the linkage member (5) is positioned in the working position at an angle with respect to the longitudinal axis of the fastener.

7. The wearable device according to claim 1, wherein the device comprises a locking element (38) including a first and a second locking member, wherein the first locking member is positioned at the base element (3) opposite the second locking member when the guidance element (4) is positioned in its initial position, wherein the second locking member is positioned at a subassembly of the movable guidance element (4) and wherein the linkage member (5) is configured to lock the subassembly during an engagement of the first and second locking member in the initial position.

8. The wearable device according to claim 7, wherein the locking element (38) is a magnetic locking element.

9. The wearable device according to claim 1, wherein the guidance element (4) comprises a guidance wheel (40) for guiding a line of a fitness apparatus, wherein the guidance wheel (40) has a single-sided connection to the linkage member (5).

10. The wearable device according to claim 1, wherein the fastener (2) is selected from the group consisting of a wraparound pad, an elastic band, a cloth, and a clip.

11. The wearable device according to claim 10, wherein the fastener (2) is releasably connected to the base element (3), such that the fastener (2) can be worn as a separate item.

12. The wearable device according to claim 1, wherein the base element (3) has a predetermined height for spacing a line with respect to a body part by at least 20 mm.

13. The wearable device according to claim 1, wherein the wearable device is an ankle band.

14. A fitness apparatus comprising the wearable device according to claim 1.

15. The fitness apparatus according to claim 14, wherein the fitness apparatus comprises a winding device which is arranged to wind up the line.

* * * * *